US006439978B1

(12) United States Patent
Jones et al.

(10) Patent No.: US 6,439,978 B1
(45) Date of Patent: Aug. 27, 2002

(54) SUBSTRATE POLISHING SYSTEM USING ROLL-TO-ROLL FIXED ABRASIVE

(75) Inventors: Oliver David Jones, Watsonville; David T. Frost, San Jose, both of CA (US)

(73) Assignee: Oliver Design, Inc., Scotts Valley, CA (US)

( * ) Notice: Subject to any disclaimer, the term of this patent is extended or adjusted under 35 U.S.C. 154(b) by 29 days.

(21) Appl. No.: 09/656,532

(22) Filed: Sep. 7, 2000

(51) Int. Cl.[7] ..... B24B 7/00

(52) U.S. Cl. ..... 451/168; 451/41; 451/307; 451/59

(58) Field of Search ..... 451/168, 41, 296, 451/304, 307, 392, 301, 309, 328, 336, 904, 59

(56) References Cited

U.S. PATENT DOCUMENTS

| | | | | |
|---|---|---|---|---|
| 5,643,044 A | | 7/1997 | Lund | |
| 5,692,947 A | | 12/1997 | Talieh et al. | |
| 5,722,877 A | * | 3/1998 | Meyer et al. | 451/41 |
| 5,727,989 A | * | 3/1998 | Ohno et al. | 451/41 |
| 5,851,136 A | | 12/1998 | Lee | |
| 5,908,530 A | | 6/1999 | Hoshizaki et al. | |
| 5,938,504 A | | 8/1999 | Talieh | |
| 6,135,859 A | * | 10/2000 | Tietz | 451/41 |
| 6,220,094 B1 | * | 4/2001 | Johnson | 451/59 |
| 6,273,800 B1 | * | 8/2001 | Walker et al. | 451/41 |
| 6,325,706 B1 | * | 12/2001 | Krusell et al. | 451/296 |

OTHER PUBLICATIONS

Gagliardi, J. et al., "Total Planarization of the MIT 961 Mask Set Wafer Coated With HDP Oxide" *CMP–MIC* Conference (Mar. 2000) 373–378.

Jin, Raymond r. et al., "Advanced Front End CMP And Integrated Solutions" *CMP–MIC Conference* (Mar. 2000) 119–128.

Romer, A. et al., "STI–CMP Using Fixed Abrasive Demands, Measurement Methods And Results" *CMP–MIC Conference* (Mar. 2000) 265–274.

* cited by examiner

*Primary Examiner*—Joseph J. Hail, III
*Assistant Examiner*—Lee Wilson
(74) *Attorney, Agent, or Firm*—Skjerven Morrill LLP

(57) ABSTRACT

A substrate polishing system includes two hollow drums and motors for driving the drums in a reciprocating manner. An abrasive tape wound on supply and takeup rollers is introduced, with the supply roller mounted inside one of the drums and the takeup roller mounted inside the other drum. The abrasive tape exits the interior of each drum through a slot in the surface of the drum. Between the drums the abrasive tape passes over a platen having a bearing surface. A substrate is mounted in a carrier and forced against the abrasive tape where it overlies the bearing surface. The drums are rotated reciprocally, thereby causing the abrasive tape to move back and forth over the platen and polishing the substrate. After a substrate has been polished the tape is advanced a selected distance by indexing motors that are connected to the supply and takeup rollers. After several substrates have been polished, each successive substrate is exposed to a section of the abrasive tape that has experienced the same amount of wear. Thus the uniformity of polishing between substrates is improved. Also, the use of the drums allows the tape to reach a desired speed in order to polish the substrate in a minimal period of time. Abrasive tape conditioners are positioned on the sides of the carrier. Because the tape moves back and forth under the conditioners, rather than only in a single direction, the cleaning of the tape is improved. In an alternative embodiment the tape is not abrasive and instead an abrasive slurry is applied to the tape.

14 Claims, 1 Drawing Sheet

SUBSTRATE POLISHING SYSTEM USING ROLL-TO-ROLL FIXED ABRASIVE

FIELD OF THE INVENTION

This invention relates to systems for polishing semiconductor wafers and other substrates.

BACKGROUND OF THE INVENTION

In many areas of technology it is necessary to polish a substrate to a high degree of planarity. For example, in the manufacture of integrated circuit chips, a semiconductor wafer having thin films of a dielectric or metal deposited on it must be polished to provide a planar surface on which further processing can be performed. The substrates used in the manufacture of data storage disks must also be polished.

Chemical-mechanical polishing (CMP) is a known technique for polishing substrates. In the most common CMP systems the substrates are rotated while an abrasive slurry is introduced between the surface to be polished and a polishing pad. Grains of the abrasive slurry are trapped between the surface and the polishing pad, and the relative movement between the surface and the polishing pad causes the grains to impact and wear down the surface. A problem with slurry systems is that the grains impact both "peaks" and "valleys" of the surface, and this limits the ability of the system to planarize the surface. Also, the substrates are exposed to different conditions as the polishing pad wears out, and this has an adverse effect on the uniformity of the polished substrates. Other problems are "dishing" erosion of the substrates, which are inherent in a slurry polishing process.

More recently, so-called "fixed abrasive" systems have come into use. In these systems, the abrasive grains are adhered to a film (roughly in the manner of ordinary sandpaper) and the surface to be planarized and the fixed abrasive are moved relative to one another. In the Obsidian Flatland™ 501 polisher marketed by Applied Materials, Inc., the substrate is held on a carrier and pressed downward onto the fixed abrasive. The carrier is moved in an orbital pattern against the abrasive. The abrasive is provided in a roll-to-roll form and is stepped forward periodically so that each wafer is exposed to a polishing surface with a similar wear pattern. This helps to overcome the non-uniformity problem mentioned above.

Despite the improvements that have been made, there still exists a need for a polishing system that efficiently polishes substrates to a high degree of planarity and provides a high degree of uniformity, both as to a given substrate and across a batch of substrates.

SUMMARY OF THE INVENTION

A substrate polishing system according to this invention comprises a first drum and a second drum rotatable about parallel axes. At least one reciprocating motor is used to rotate the first and second drums in a reciprocating manner. The system also includes a platen having a bearing surface and an abrasive tape extending from a supply roller to a takeup roller. The supply roller is mounted inside the first drum, and the takeup roller is mounted inside the second drum. The supply and takeup rollers have axes that are parallel to (or may coincide with) the axes of the first and second drums. The abrasive tape extends through an opening in the first drum, over the bearing surface, and through an opening in the second drum. At least one indexing motor is used to rotate at least one of the supply and takeup rollers in a given direction. A substrate carrier is used to press a substrate against the abrasive tape in a region adjacent the bearing surface.

In one embodiment separate reciprocating motors drive the drums and separate indexing motors drive the supply and takeup rollers.

The substrate is polished as the reciprocating motors drive the drums and cause the abrasive tape to move back and forth between the substrate and the bearing surface of the platen. After a substrate has been polished, the indexing motors advance the tape a preselected distance from the supply roller to the takeup roller. Then a second substrate is polished and the tape is advanced by the preselected distance again. In this way, after several substrates have be processed, each successive substrate is exposed to a section of the abrasive tape that has be worn to the same degree. Therefore, the polishing of successive substrates is highly uniform.

This invention also includes a method of polishing a substrate comprising pressing the substrate against an abrasive tape; reciprocating the abrasive tape; and advancing the abrasive tape periodically and incrementally in a first direction.

BRIEF DESCRIPTION OF THE DRAWINGS

The single FIGURE of the drawing shows a side view of a substrate polishing system in accordance with this invention.

DESCRIPTION OF THE INVENTION

Figure 1:
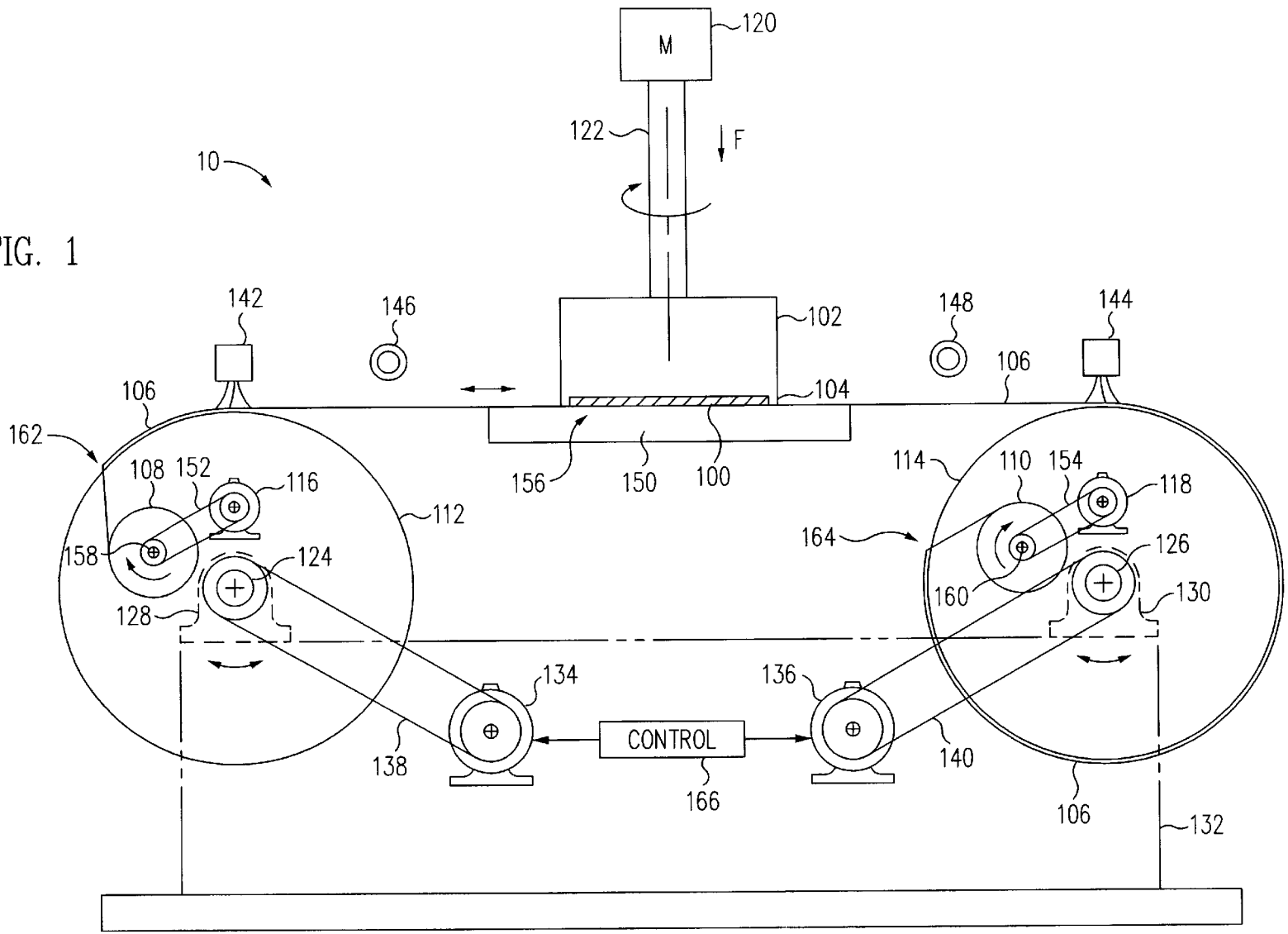

The FIGURE of the drawing shows a side view of a substrate polishing system 10 in accordance with this invention. A substrate, in this case a semiconductor wafer 100, is held in a substrate carrier 102 surrounded by a retaining ring 104. Substrate carrier 102 is mounted on a shaft 122 which is rotated by a carrier motor 120. The motion provided by motor 120 may take various forms, including concentric or oscillating. A downward force F is imposed on substrate carrier 102, forcing wafer 100 against a fixed abrasive sheet or tape 106. In the region below carrier 102, abrasive tape 106 is supported by a platen 150, which has a bearing surface 156.

Abrasive tape 106 is wound on a supply roller 108 and a takeup roller 110 and may be, for example, a Fixed Abrasive available from 3M. Rollers 108 and 110 are positioned on rotatable shafts 158 and 160 inside hollow drums 112 and 114, respectively. Supply roller 108 is driven be an indexing motor 116 via a belt 152, and takeup roller 110 is driven by an indexing motor 118 via a belt 154. Drums 112 and 114 rotate about shafts 124 and 126, which are mounted in bearings 128 and 130 on a base 132. Drum 112 is driven by a reciprocating motor 134 via a belt 138, and drum 114 is driven by a reciprocating motor 136 via a belt 140. Abrasive tape leaves supply roller 108 and passes through a slot or opening 162 in the surface of drum 112, between substrate 100 and bearing surface 156, through a slot or opening 164 in the surface of drum 114 and onto takeup roller 110.

While in polishing system 10 shown in the drawing substrate 100 and bearing surface 156 are oriented horizontally, it will be apparent that in other embodiments substrate 100 and bearing surface 156 could be oriented vertically or in some other direction.

In one embodiment drums 112 and 114 are 2 feet in diameter, and rollers 108 and 110 have a diameter of from 3.5" (empty) to 7" (fully wound).

Motors 134 and 136 are controlled by a control system 166 to rotate drums 112 and 114 in unison such that abrasive tape 106 is reciprocated back and forth between wafer 100 and bearing surface 156. Numerous possibilities are available for the rotation, the important factor being to achieve a tape speed (e.g., 0.5–10 feet per second) and duration that will satisfactorily polish the wafer. Thus, drums 112 and 114 can be rotated through 360 degrees or more in each direction, for example. Another factor that determines the speed of abrasion is the magnitude of the force F between the wafer and the abrasive tape.

Alternatively, drums 112 and 114 could be linked by a chain and sprocket, for example and only a single motor could be used to reciprocate both drums in unison.

When a single wafer has been polished, motors 116 and 118 drive rollers 108 and 110 to advance tape 106 a selected distance (e.g., 0.5–2"). Another wafer is mounted into carrier 102, and drums 112 and 114 are reciprocated again until the second wafer is polished. Again, rollers 108 and 110 are advanced the selected distance and a third wafer is mounted into carrier 102. The polishing process is then repeated.

In an alternative process, rollers 108 and 110 can be controlled so as to advance tape 106 while drums 112 and 114 are reciprocating.

After several wafers have been processed in this way, each successive wafer is exposed to a section of the abrasive tape 106 that has seen the same amount of wear. This run-in period could require that 5–10 wafers be processed, for example.

Since the diameter of the tape 106 on rollers 108 and 110 varies as the tape is advanced from supply roller 108 to takeup roller 110, motors 116 and 118 are controlled to rotate rollers 108 and 110 differentially so as to advance the tape an equal preselected distance after each polishing operation. Alternatively, tape could be driven by a capstan drive (not shown) or an indexing pawl mechanism (not shown), which would eliminate this complication.

Abrasive tapes generally must be conditioned, or cleaned, periodically in order to remove particles of the abraded material. Conditioners 142 and 144 are positioned adjacent the tape 106 on opposite sides of substrate carrier 102. Each of conditioners 142 and 144 can be a fixed or rotating brush, a hard surface or diamond-coated pad dressing mechanism, a high-pressure fluid spray, or an ultrasonic or megasonic transducer with a fluid coupling to the tape or pad surface, for example. As the tape reciprocates, each conditioner operates against the tape once in each direction, thereby improving the cleaning of the tape as compared with arrangements wherein the tape moves only in one direction against the conditioner.

Fluid dispensers 146 and 148 are used to dispense a fluid that is applied to the abrasive tape during polishing. For example, the fluid may be deionized water with an alkaline chemical such as KOH or $NH_4OH$ added to adjust the pH. A surfactant may also be added.

In another embodiment, tape 106 is not an abrasive tape and instead dispensers 146 and 148 are used to dispense an abrasive slurry onto tape 106.

The embodiments described above are illustrative only, and not limiting. Many alternative embodiments in accordance with this invention will be apparent to persons skilled in the art from the above description.

What is claimed is:

1. A substrate polishing system comprising:

a first drum and a second drum rotatable about parallel axes;

at least one reciprocating motor for rotating the first and second drums in a reciprocating manner;

a platen having a bearing surface;

an abrasive tape extending from a supply roller to a takeup roller, the supply roller being mounted inside the first drum, the takeup roller being mounted inside the second drum, the supply and takeup rollers having axes parallel to or coincident with the axes of the first and second drums, respectively, the abrasive tape extending through a first opening in the first drum, over the bearing surface, and through a second opening in the second drum;

at least one indexing motor for rotating at least of one of the supply and takeup rollers; and a substrate carrier for pressing a substrate against the abrasive tape in a region adjacent the bearing surface.

2. The substrate polishing system of claim 1 comprising a first reciprocating motor for driving the first drum and a second reciprocating motor for driving the second drum.

3. The substrate polishing system of claim 2 comprising a first belt connecting the first motor to the first drum and a second belt connecting the second motor to the second drum.

4. The substrate polishing system of claim 1 comprising a first indexing motor for driving the supply roller and a second indexing motor for driving the takeup roller.

5. The substrate polishing system of claim 4 comprising a first belt connecting the first indexing motor to the supply roller and a second belt connecting the second indexing motor to the takeup roller.

6. The substrate polishing system of claim 1 comprising a first abrasive conditioner positioned adjacent the abrasive tape on a first side of the substrate carrier.

7. The substrate polishing system of claim 6 comprising a second abrasive conditioner positioned adjacent the abrasive tape on a second side of the substrate carrier.

8. The substrate polishing system of claim 1 comprising a carrier motor for moving the substrate carrier.

9. The substrate polishing system of claim 1 wherein the substrate comprises a semiconductor wafer.

10. A substrate polishing system comprising:

a first drum and a second drum rotatable about parallel axes;

at least one reciprocating motor for rotating the first and second drums in a reciprocating manner;

a platen having a bearing surface;

a tape extending from a supply roller to a takeup roller, the supply roller being mounted inside the first drum, the takeup roller being mounted inside the second drum, the supply and takeup rollers having axes parallel to or coincident with the axes of the first and second drums, respectively, the tape extending through a first opening in the first drum, over the bearing surface, and through a second opening in the second drum;

a dispenser for applying an abrasive slurry to the tape;

at least one indexing motor for rotating at least of one of the supply and takeup rollers; and a substrate carrier for pressing a substrate against the tape in a region adjacent the bearing surface.

11. A method of polishing a substrate comprising the steps of:

pressing the substrate against an abrasive tape;

reciprocating the abrasive tape; and advancing the abrasive tape periodically and incrementally in a first direction.

12. The method of claim 11 wherein the step of reciprocating is terminated before the step of advancing.

13. The method of claim 12 further comprising the step of pressing a second substrate against the abrasive tape after the step of reciprocating has terminated and then reciprocating the abrasive tape again.

14. The method of claim 11 wherein the step of advancing takes place during the step of reciprocating.

* * * * *